United States Patent [19]

Hazlehurst

[11] 3,942,580

[45] Mar. 9, 1976

[54] CASTING OF INGOTS

[75] Inventor: Ian Hazlehurst, Birmingham, England

[73] Assignee: Foseco International Limited, Birmingham, England

[22] Filed: Apr. 12, 1974

[21] Appl. No.: 460,579

[30] Foreign Application Priority Data

Apr. 27, 1973 United Kingdom ..... 20213/73

[52] U.S. Cl. ..... 164/55; 249/206

[51] Int. Cl.[2] ..... B22D 7/12

[58] Field of Search ..... 164/55, 56, 281; 249/206

[56] References Cited

UNITED STATES PATENTS

| | | | |
|---|---|---|---|
| 3,810,506 | 5/1974 | Kobayashi | 164/133 |

FOREIGN PATENTS OR APPLICATIONS

| | | | |
|---|---|---|---|
| 7,142,305 | 2/1969 | Japan | 249/206 |
| 887,556 | 12/1971 | Canada | 164/281 |
| 795,978 | 6/1958 | United Kingdom | 249/206 |
| 1,096,706 | 12/1967 | United Kingdom | 164/56 |
| 889,188 | 2/1962 | United Kingdom | 249/206 |
| 523,595 | 4/1952 | Canada | 249/206 |

*Primary Examiner*—Francis S. Husar
*Assistant Examiner*—Carl Rowold
*Attorney, Agent, or Firm*—Cushman, Darby & Cushman

[57] ABSTRACT

Ingot casting splashcans are formed of a composition which melts during teeming of the ingot to form a molten casting flux.

4 Claims, No Drawings

CASTING OF INGOTS

This invention relates to the casting of ingots, particularly to the casting of metal ingots.

In casting top-poured ingots, it is conventional practice to locate on the base of the mould an upright hollow open ended cylinder, usually of cardboard or sheet metal; the molten metal is poured into this cylinder and impact on the walls of the cylinder so as to minimise the impact of molten metal splashes hitting the mould wall itself. As a result, the number of splashes on the mould wall, which would lead to surface defects in the final cast ingot is also reduced. Such a hollow cylinder is conventionally referred to as a "splashcan" and, for simplicity of expression, this term will be used hereinafter to embrace such devices and analogous devices for the same purpose.

According to a first feature of the present invention, there is provided a splashcan formed of a composition which, under the action of the heat of the molten metal, melts to form a molten metal casting flux. Such flux compositions are, of course, well known per se but they have not, it is believed, previously been used to form splashcans. For use in steel casting, such compositions preferably melt at temperatures from 600° – 1,500°C.

The dimensions and shape of the splashcans according to the invention may vary widely, but it is generally preferable that it be a cylindrical sleeve at least 75mm in length. The wall thickness and diameter of such a sleeve will vary as a function both of the material used, and of the application rate of flux composition to molten metal. Preferably the application rate is 400 – 700 gms per tonne of molten metal cast.

Some sleeve shapes will be sufficiently squat to require no fixing devices in the mould; however, for tall shapes or in situations where such a sleeve might be caused to topple, additional support members may be provided, for example metal tie rods or clips.

Splashcans in the form of sleeves may be made by a wide variety of known techniques and using a wide variety of materials. Two particular types of manufacture may be distinguished, those of forming a mixture of predominantly particulate materials to shape, and causing the so formed shape to form a coherent rigid sleeve, and those of entrapping the particulate flux materials in a fibrous matrix, which may either be formed as a coherent rigid sleeve as such or as a flexible web material, a section of which may be folded to form a sleeve.

A typical process of the first type is hard ramming a mixture of particulate fluxing agent (selected from e.g. sodium carbonate, fluorspar, stearic acid, sodium fluoride, anthracene, glass, fly ash, cryolites or mixtures of any of these) with a suitable binder (e.g. a natural or synthetic gum or resin, a clay, starch, carboxymethyl cellulose, dextrin, linseed oil or other drying oil), to the desired shape, and then drying or stoving the rammed shape.

The second type of manufacture preferably comprises the steps of forming a slurry, preferably aqueous, of the fibre to be used (e.g. refractory fibres such as calcium silicate fibres, glass fibres or synthetic organic fibres such as nylon, polyacrylonitrile, rayon polyethylene, terephthalate or polyurethane fibres), together with a proportion of a suitable flux as filler, for example one of those mentioned above. A proportion of binding agent may be included, though this may not be necessary if the fibrous material forms, of itself, a sufficiently strong and coherent matrix.

Sleeves may be made as such by dewatering the slurry on to a cylindrical former to deposit a layer of fibrous and particulate material thereon, removing the so formed sleeve from the former and drying it. Alternatively, the slurry may be dewatered to give a damp coherent strip of material, which may be sealed in an airtight container (e.g. a plastic bag) to prevent drying out, and when wanted for use, quickly formed to shape, dried out and used. If the strip contains sufficient fibre, it is flexible even when dry, and the precaution of sealing in a plastic bag may be avoided.

The splashcans may contain ingredients additional to those specified above. In particular, the inert or reducing nature of the atmosphere above the molten metal surface in the ingot mould during pouring may be modified by the inclusion of carbon containing materials, e.g. newsprint or polytetrafluoroethylene.

The following Examples will serve to illustrate the invention. In these Examples, all percentages are by weight.

EXAMPLE 1

Four compositions were made up as follows by direct mixing of the particulate ingredients:

| | | |
|---|---|---|
| A: | fluorspar | 75% |
| | sodium carbonate | 22.5% |
| | sodium fluoride | 2.5% |
| B: | fluorspar | 77.5% |
| | sodium carbonate | 20% |
| | anthracene | 2.5% |
| C: | fluorspar | 50% |
| | sodium carbonate | 20% |
| | stearic acid | 30% |
| D: | fluorspar | 40% |
| | sodium carbonate | 20% |
| | stearic acid | 40% |

All these mixtures were mixed with a solution of vegetable resin in ethanol to give a thick mouldable paste which was formed to shape and allowed to set. Sleeves formed in this way were used as splashcans on test steel ingot casts. In all cases, the sleeves functioned well in maintaining the ingot mould surface free of splashes, and this, combined with the fluxing effect of the sleeve, led to ingots of high surface quality.

EXAMPLE 2

Aqueous slurries were made up containing 5 to 15% solids of a composition as follows:

| | | |
|---|---|---|
| E: | fluorspar | 76% |
| | calcium silicate fibres | 19% |
| | phenolic resin | 5% |
| F: | fluorspar | 65% |
| | calcium silicate fibres | 20% |
| | phenolic resin | 5% |
| | polytetra fluoroethylene | 10% |
| G: | fluorspar | 60% |
| | calcium silicate fibres | 25% |
| | phenolic resin | 5% |
| | pulverised glass | 5% |
| | cryolite | 5% |

These slurries could be dewatered on to a 40mm diameter cylindrical perforated former to give sleeves of thickness 25 mm, which after stripping from the former, were dried at 180°C. These sleeves functioned satisfactorily as splashcans and high quality ingots were produced using them.

I claim as my invention:

1. In the method of casting an ingot, the improvement which comprises:

locating on the floor of an ingot mould a splashcan formed of a composition which, under the action of the heat of the molten metal, melts to form a molten casting flux, said composition consisting essentially of a minor proportion of inorganic fibrous material, a major proportion of at least one fluxing agent, and a binder, passing molten metal into the mould and into the splashcan, the splashcan gradually melting to form a casting flux on the molten metal and coating the walls of the ingot mould with casting flux as the level of molten metal rises in the ingot, and allowing the molten metal to solidify in the mould.

2. A splashcan for use in the casting of ingots which is formed from a composition consisting essentially of:

a minor proportion of inorganic fibrous material, a major proportion of at least one fluxing agent, and a binder, which composition in use and under the action of the heat of molten metal gradually melts to form a molten metal casting flux on the molten metal and coats the walls of the ingot mould with casting flux as the level of molten metal rises in the ingot.

3. A splash can according to claim 2 wherein the melting point of the composition is 600 to 1,500°C.

4. A splashcan according to claim 2 which is in the form of a hollow cylinder, open at both ends.

* * * * *